United States Patent [19]

Wadensten

[11] 4,015,712

[45] Apr. 5, 1977

[54] BASKET ADAPTED TO BE STACKED IN OR ON TOP OF ANOTHER SUBSTANTIALLY IDENTICAL BASKET

[75] Inventor: Carl Tommy Wadensten, Falkenberg, Sweden

[73] Assignee: Kommanditbolaget Pemac Invention AB & Co., Falkenberg, Sweden

[22] Filed: Sept. 4, 1975

[21] Appl. No.: 610,371

Related U.S. Application Data

[63] Continuation-in-part of Ser. No. 502,626, Sept. 3, 1974, abandoned.

[52] U.S. Cl. ..... 206/507; 206/513; 224/48 W

[51] Int. Cl.[2] ..... B65D 85/62

[58] Field of Search ..... 224/48 F, 48 W, 48 C; 206/507, 506, 513, 511, 505, 515, 512, 503; 217/36, 38; 220/19, 97

[56] References Cited

UNITED STATES PATENTS

| | | | |
|---|---|---|---|
| 2,252,964 | 8/1941 | Faulkner | 206/506 |
| 2,931,535 | 4/1960 | Lockwood | 206/507 |
| 3,160,308 | 12/1964 | Hare et al. | 220/19 |
| 3,317,075 | 5/1967 | Drader | 206/513 |
| 3,622,031 | 11/1971 | Wells | 206/507 |
| 3,887,073 | 6/1975 | Wilson | 206/507 |
| 3,939,981 | 2/1976 | King | 206/507 |

*Primary Examiner*—Robert J. Spar
*Assistant Examiner*—Kenneth Noland
*Attorney, Agent, or Firm*—Norman Lettvin

[57] ABSTRACT

Basket for stacking in or on top of another identical basket comprising a bottom and side walls, said side walls being substantially vertical and assembled from a number of rod-like elements obliquely upstanding from said bottom to the plane of the basket bottom.

22 Claims, 27 Drawing Figures

61
71
81
91
100
151
131
121
111
101
51
41
31
21

FIG. 8
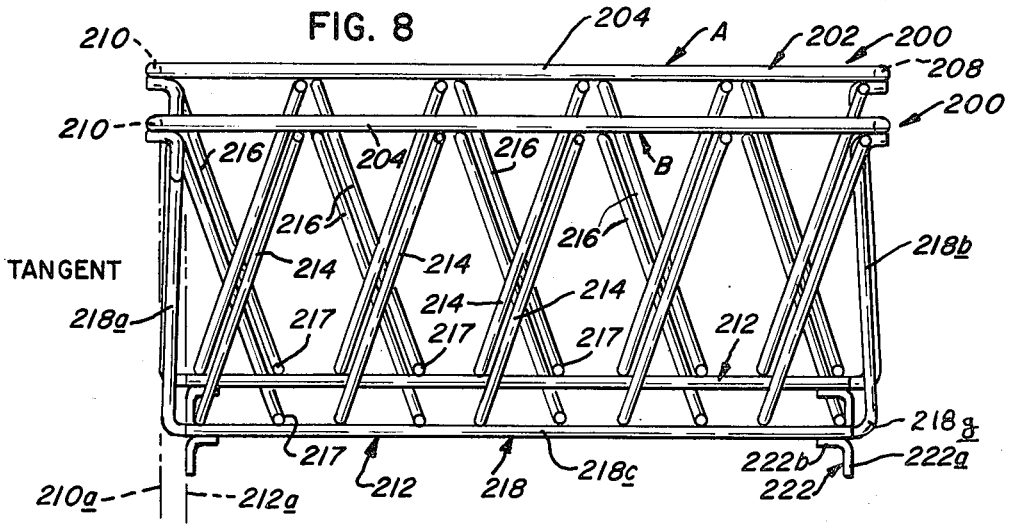
FIG. 9
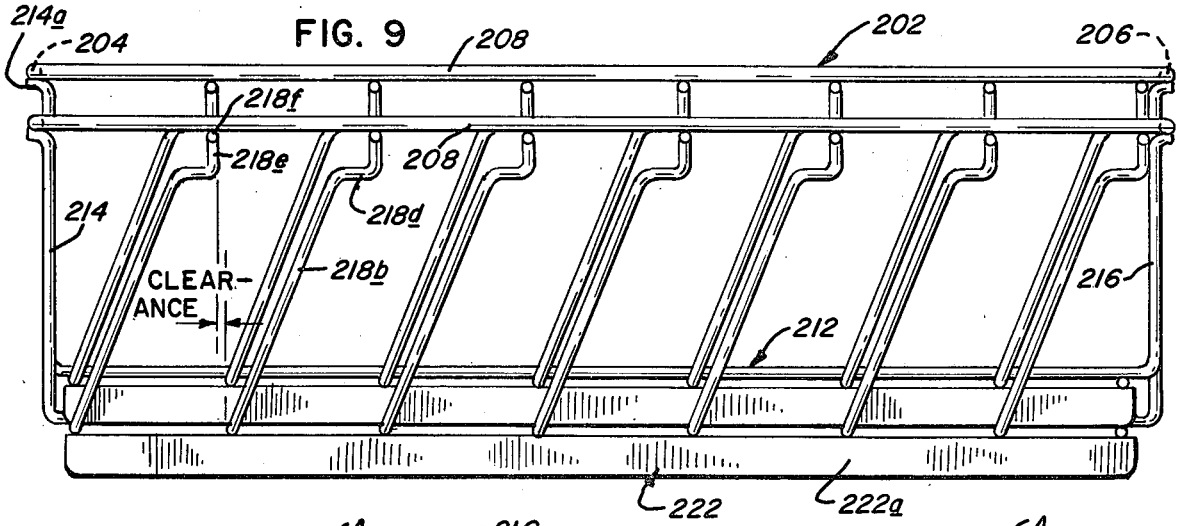
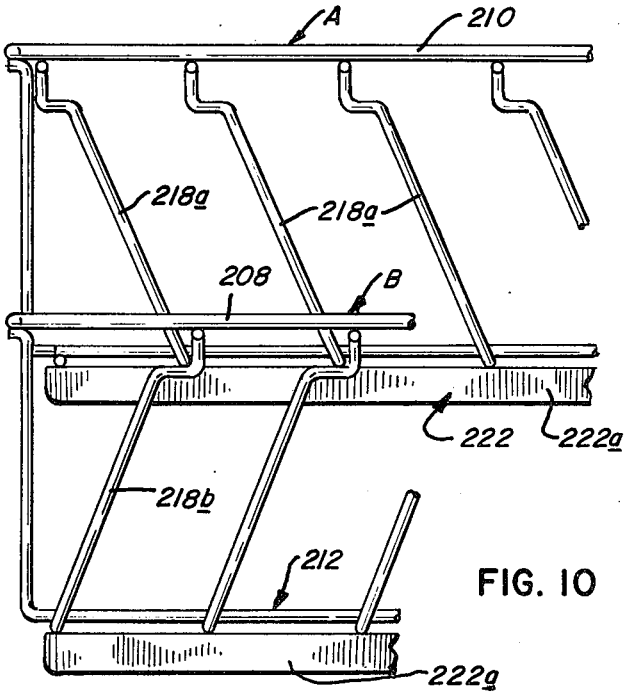
FIG. 10
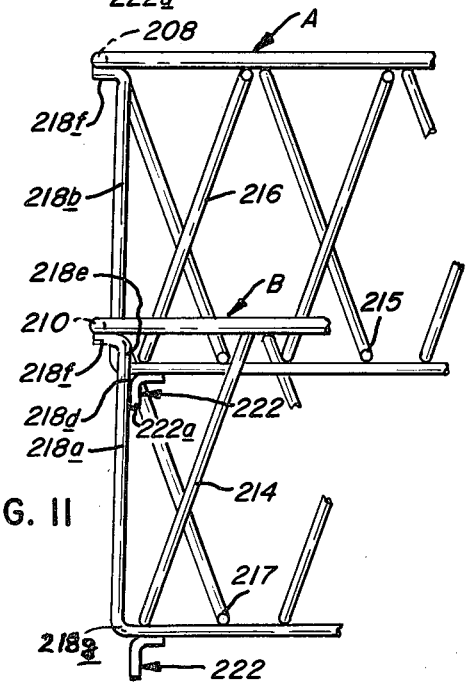
FIG. 11

FIG. 19
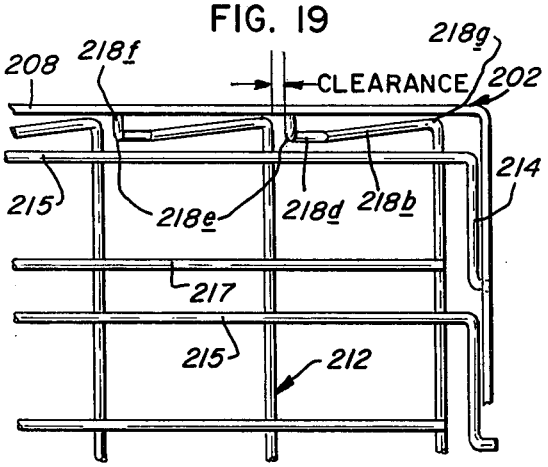
FIG. 20
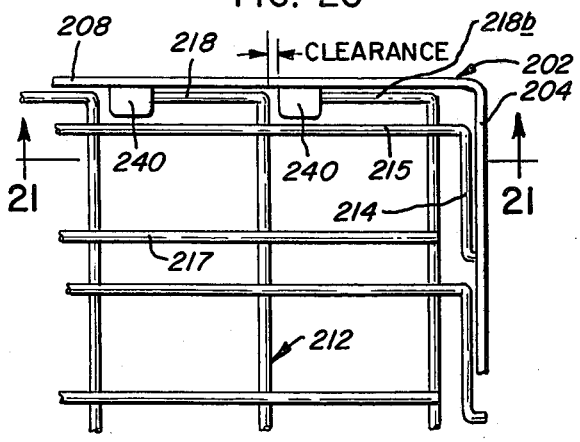
FIG. 21
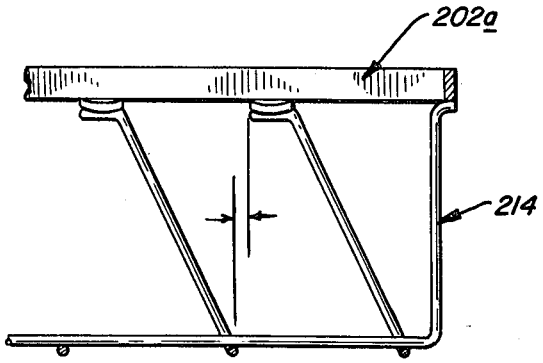
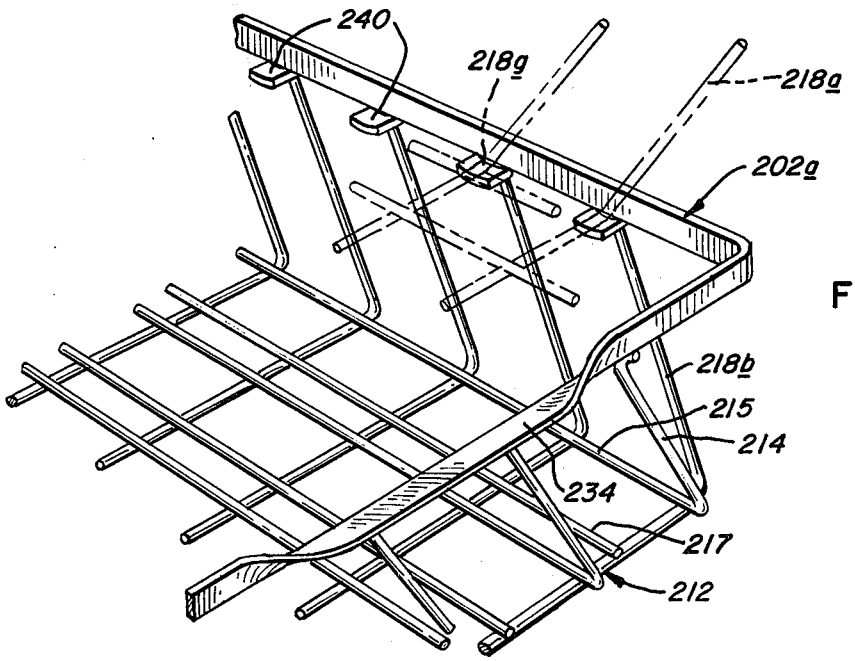
FIG. 22

BASKET ADAPTED TO BE STACKED IN OR ON TOP OF ANOTHER SUBSTANTIALLY IDENTICAL BASKET

CROSS-REFERENCE TO RELATED APPLICATIONS

This application is a continuation-in-part of my copending application, Ser. No. 502,626 filed Sept. 3, 1974 now abandoned.

BACKGROUND OF THE INVENTION

This invention relates to a basket adapted to be stacked in or on top of another substantially identical basket with a bottom and side walls.

Great requirements are put on the containers, baskets and crates in which filled and empty bottles and the like are conveyed. For instance, the walls of the crates shall be as vertical as possible so that the relative movements between the bottles will be as small as possible. Hitherto such crates have been made of wood and lately also of plastic. These prior art crates are costly because of the material from which they are made, and they also suffer from the great drawback that they cannot be stacked in each other in the empty state, from which problems of transportation and storage have resulted.

Others have heretofore sought, with varying degrees of success, to provide baskets that selectively nest (stack within) or stack on each other. In such prior devices the various inventors have perceived a need for certain features, but none have created the combinations that are disclosed herein. Thus, while patents, such as U.S. Pat. No. 2,252,964 disclose the utility of vertical sides over tapering sides, movable means may be needed to transform such baskets from a nesting condition to a stacking condition. While patent U.S. Pat. No. 2,931,535 discloses utility of inclined parallel wire members in side walls having inter-engaging shoulders and feet at the ends thereof, such baskets are required to be shifted and offset horizontally in order to effect nesting. While patents, such as U.S. Pat. Nos. 2,252,964, 2,964,211, 3,481,507 and 3,622,031 disclose utility in rotating the baskets, from a position where multiple baskets appear identically, about a vertical axis by 90° or 180° to effect stacking rather than nesting, such constructions normally utilize inclined wall elements and other wall parts to abut by interference or be telescoping into each other, thereby risking the jamming together of elements that could interfere with the ability to separate nested baskets.

BRIEF SUMMARY OF THE INVENTION

The object of the present invention is to eliminate the disadvantages of the prior art containers, baskets and crates to the largest extent possible.

To this end, the side walls of the baskets according to the invention are substantially vertical and assembled from a number of wire or rod-like elements upstanding from the bottom of the basket, said elements occupying in each side wall plane an oblique position to the plane of the basket bottom.

Another object of the present invention is to simplify the prior art designs but also provide a wire basket of rectangular load receiving space. To this end, the wire basket has the wires of at least two opposed side walls aligned, and a portion constituting a supporting surface is provided at the upper ends of the wires in the two opposed side walls.

Another object of the invention is to provide a wire basket in which the wires constituting the side walls are bent at an angle smaller than 90° or at an angle of 90° with the bottom plane and extend up to the opposite side wall.

A further object of the present invention is to provide a wire basket in which the wires having a portion forming a supporting surface are bent at an angle smaller than 90°, in order that part of the bottom forming section of said wires shall be able to cooperate with the supporting surface forming portion of another basket.

And still a further object of this invention is to provide (1) a basket construction of improved character, yet of relatively inexpensive construction, (2) wherein the basket may both stack or nest, (3) where the nesting character is not achieved at the expense of the vertical character of the inner projected confines of the walls of the basket, or at the expense of the ability of nested baskets to be readily separated, (4) where the nesting character is maximized to the extent that loss of vertical space during nesting is at a minimum, and (5) where the stacking character is secured simply by rotation of one basket relative to the basket beneath without any moving parts on the basket, and the elements for achieving stacking are located at such predetermined spacings longitudinally of sides of the basket, and at such projections inwardly within the vertical projections of the walls of the baskets, as to assure nesting without jamming, but to insure stacking, with minimum effort at alignment of baskets one above the other both during nesting and stacking.

BRIEF DESCRIPTION OF THE DRAWINGS

Embodiments of the invention will be more fully described hereinbelow and with reference to the accompanying drawings in which:

FIGS. 8–13 show an embodiment of the invention of the type generally illustrated in FIGS. 6 and 7, with FIG. 8 showing an end elevational view of two rectangular nested baskets;

FIG. 9 is a side elevational view of the two nested baskets of FIG. 8;

FIG. 10 is an enlarged, fragmentary, elevational view of one end of two baskets of the type shown in FIG. 9, but with the upper basket having been rotated 180° and being stacked upon the lower basket;

FIG. 11 is a fragmentary and elevational view looking at the stacked baskets of FIG. 10 from a position to the left thereof;

FIG. 12 is a fragmentary perspective view of the set of baskets of FIGS. 8 and 9 showing additional details of the nested baskets;

FIG. 13 is a fragmentary perspective view of the baskets of FIG. 10 showing additional details of the stacked baskets;

FIG. 19 is a fragmentary top plan view of a portion of a basket of the type shown in FIG. 9, with similarities thereof with the construction shown in plan in FIG. 7 being evident upon comparison;

FIG. 20 is a fragmentary top plan view similar to that seen in FIG. 19, but showing a modification of the shoulder abutment element compared to that shown in FIG. 19;

FIG. 21 is a fragmentary cross-sectional view taken substantially on line 21—21 on FIG. 20;

FIG. 22 is a fragmentary perspective view, of a similar nature to the view in FIG. 13, but showing the use of the modifier shoulder abutment of FIGS. 20 and 21 in a basket stacking arrangement;

DETAILED DESCRIPTION OF THE ILLUSTRATIVE EMBODIMENT

Figure 1:
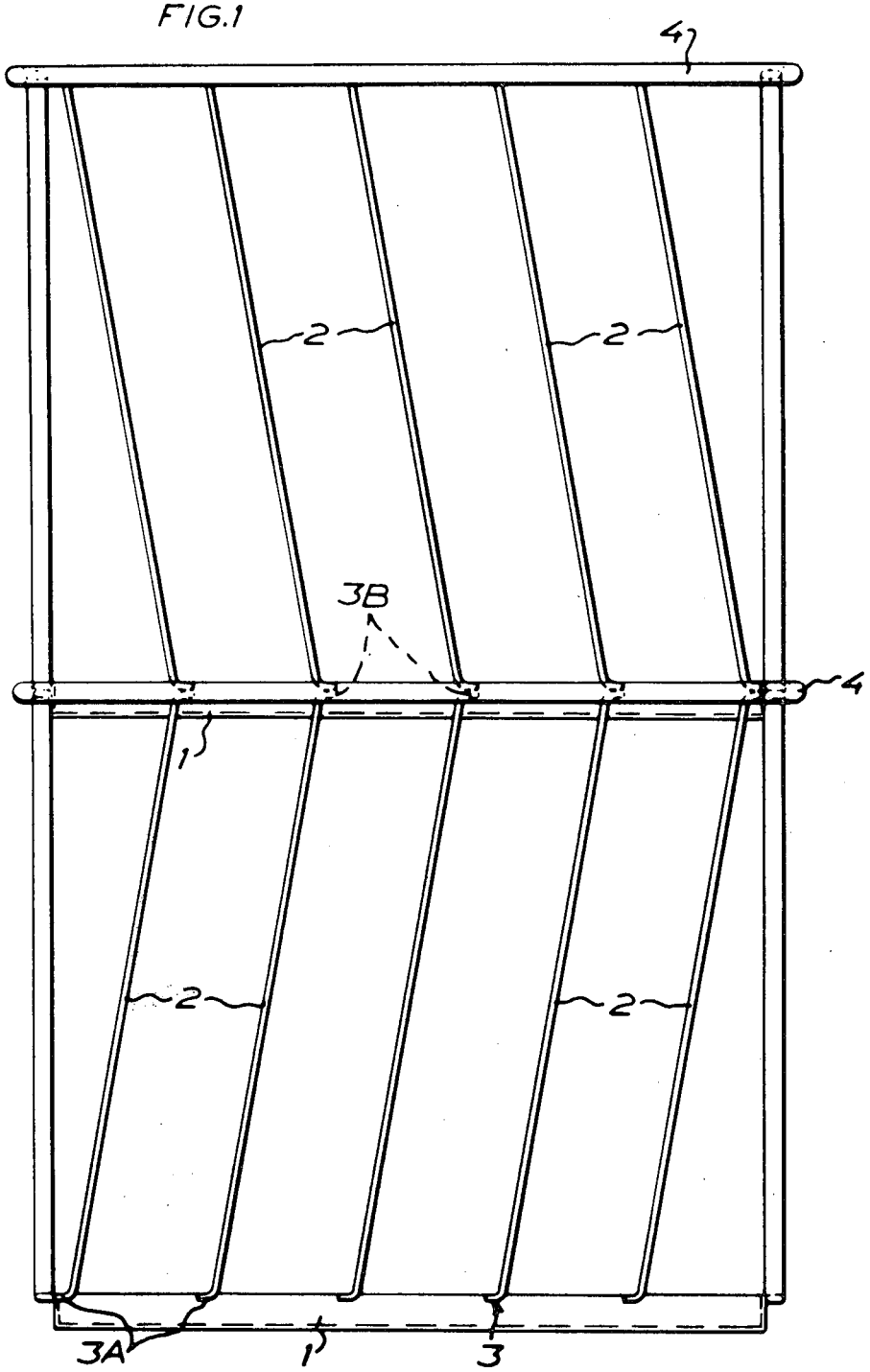
FIG. 1 is a side elevation of two baskets, according to the invention, stacked one on top of the other.
Figure 2:
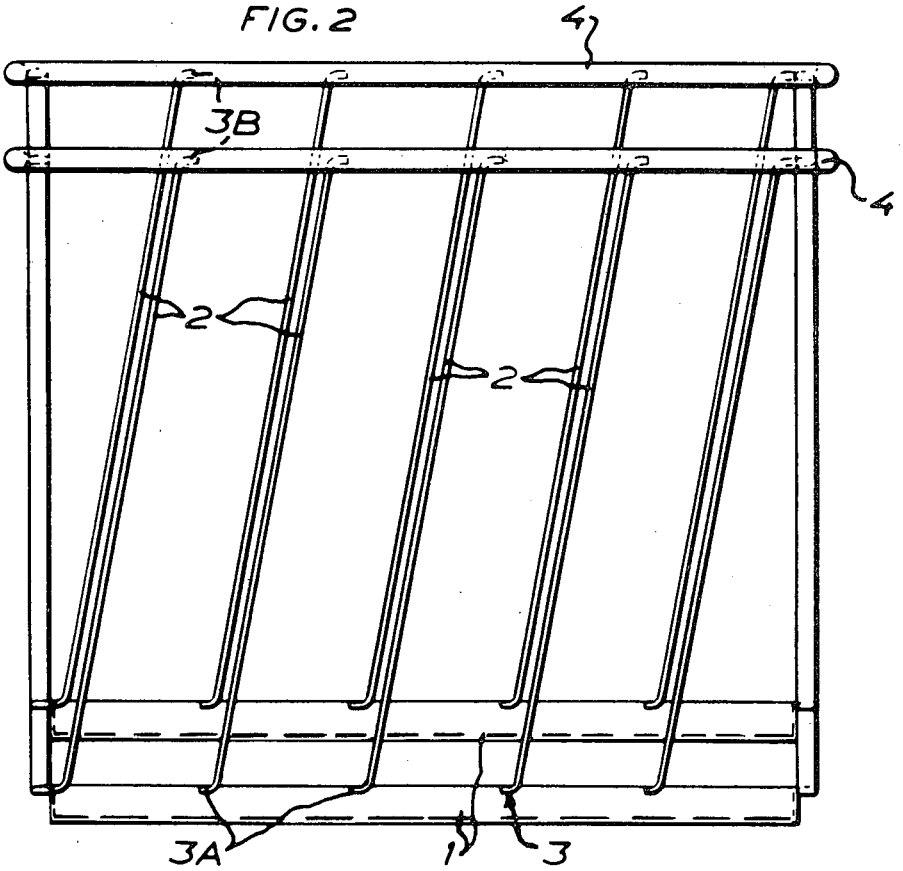
FIG. 2 is a side elevation of two baskets stacked one in the other.

In the embodiment of the invention illustrated in FIGS. 1 and 2 the basket has a square bottom 1 made of, for example, a metal sheet and having upwardly bent edges. The side walls of the basket are assembled from a number of wires 2 of substantially rectangular cross section. The wires 2 are placed at an angle to the plane of the basket bottom and their ends are bent to form a foot 3 at each end. The feet closest to the bottom plane carry the reference numeral 3A and the feet at the other end of the wires 2 carry the reference numeral 3B. The feet 3A are fastened to the outer side of the edges of the bottom sheet metal 1, while the feet 3B are fastened to the inner side of a frame 4. As will appear from FIGS. 1 and 2, the feet 3A and 3B are directed each in one direction and situated in planes parallel to the bottom plane 1 and in the plane of the side wall formed by the wires 2.

As will appear more clearly from FIG. 2, baskets according to the invention can be stacked in each other and, as will appear from FIG. 1, the baskets can also be stacked on top of each other after the baskets have been turned through an angle of 90° relative to each other. After extraction of the uppermost basket in FIG. 2 and after rotation thereof through an angle of 90°, it will obtain the same position as the uppermost basket in FIG. 1. In this position of the basket, the feet 3A of the uppermost basket will be aligned with the feet 3B of the lowermost basket, whereby the lowermost basket in FIG. 1 will carry the uppermost basket. A stack of several baskets according to FIG. 1 are stabilized by means of the frame 4 and the bottom 1.

Figure 5:
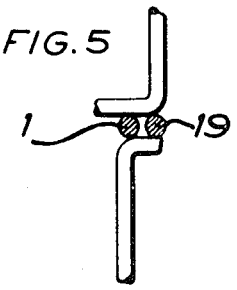
FIG. 5 is a section of parts of two baskets according to FIGS. 3 and 4 stacked one on top of the other.
Figure 3:
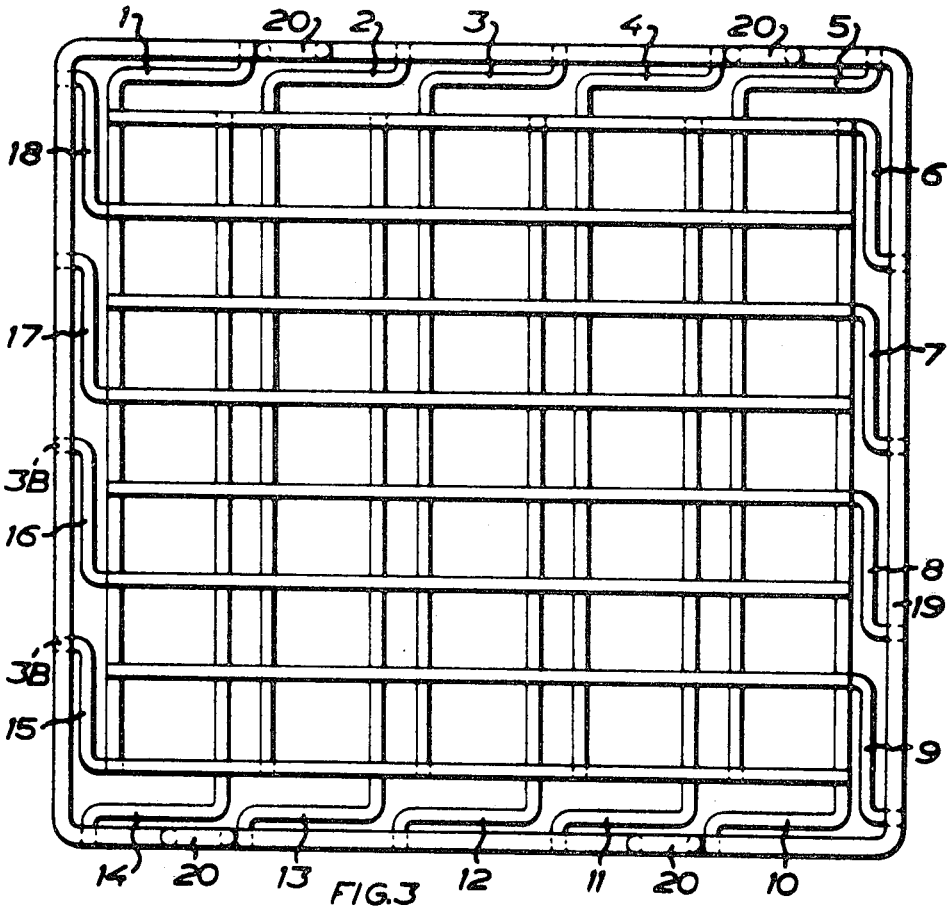
FIG. 3 is a plan view of a basket in another embodiment.

The embodiment of the invention illustrated in FIGS. 3 and 5 differs from that shown in FIGS. 1 and 2 substantially in that the basket is made entirely of wires 1–19 of circular cross section. The wires 1–18 constitute both the side walls and the bottom of the basket. The ends 3B of the wires 1–8 are, moreover, bent at right angles to the plane of the side wall formed by the wires. The frame 19 is placed on the ends 3B are connected thereto. The frame 19 also has four semi-circular outwardly bent portions 20. These portions are placed on two opposed frame parts and each near one end of said frame parts, and the outwardly bent portions of two opposed frame parts are not aligned with each other, as will appear more clearly from FIG. 4.

Figure 4:
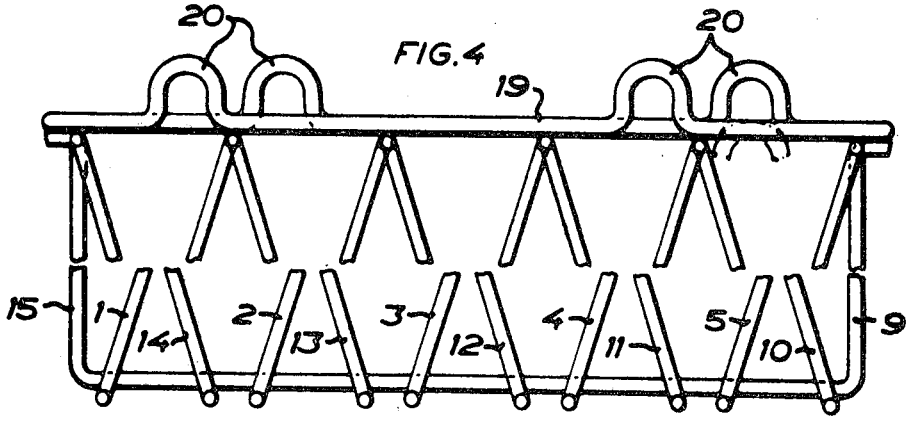
FIG. 4 is a side elevation of the basket shown in FIG. 3, the middle portion having been broken away.

It should be observed that the basket illustrated in FIGS. 3–5 is rectangular in such a way that the distance between the parts of the wires 6 and 15 extending in the bottom is greater than the distance between the side walls formed by the wires 1–5 and 10–14 but smaller than the distance between the parts of the frame 19 extending along these side walls. This is illustrated more in detail in FIG. 5 which shows how the wires are located when two baskets are stacked one on top of the other. The outwardly bent portions 20 serve, on one hand, for stabilizing stacked baskets and, on the other hand, for preventing two stacked baskets from fixedly engaging one another so that it is difficult to disassemble them. This is illustrated in FIG. 4 in which part of the outwardly bent portions 20 of another basket is shown.

In the embodiment of the invention illustrated in FIGS. 3 and 4 the baskets may be made of metal wires and the wires may be interconnected by welding or any other appropriate way.

It is not necessary to provide the outwardly bent portions 20 in the frame 19. In fact, the frame 19 in a modified embodiment thereof may be entirely smooth and the parts of the wires 6 and 15 extending in the basket bottom may be offset inwardly towards the middle of the bottom, said wire parts being replaced by wires extending merely along the bottom and provided with portions directed outwardly away from the bottom, which portions may be identical with the outwardly bent portions 20. These wires may suitably have a larger diameter than the wires 1–18, but in this modification they may be of a smaller diameter than in the embodiment illustrated in FIGS. 3–5. Apart from having the same function as the outwardly bent portions 20, these portions, which extend outwardly from the bottom, will serve as feet.

Figure 6:
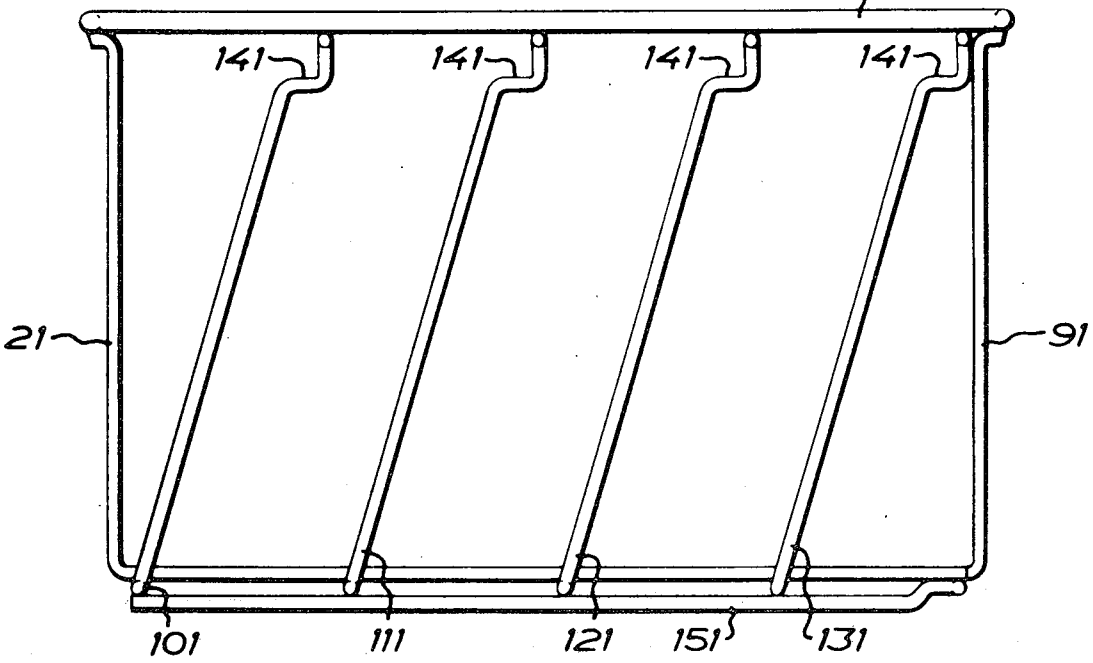
FIG. 6 is a side elevation view of a basket according to the invention.
Figure 7:
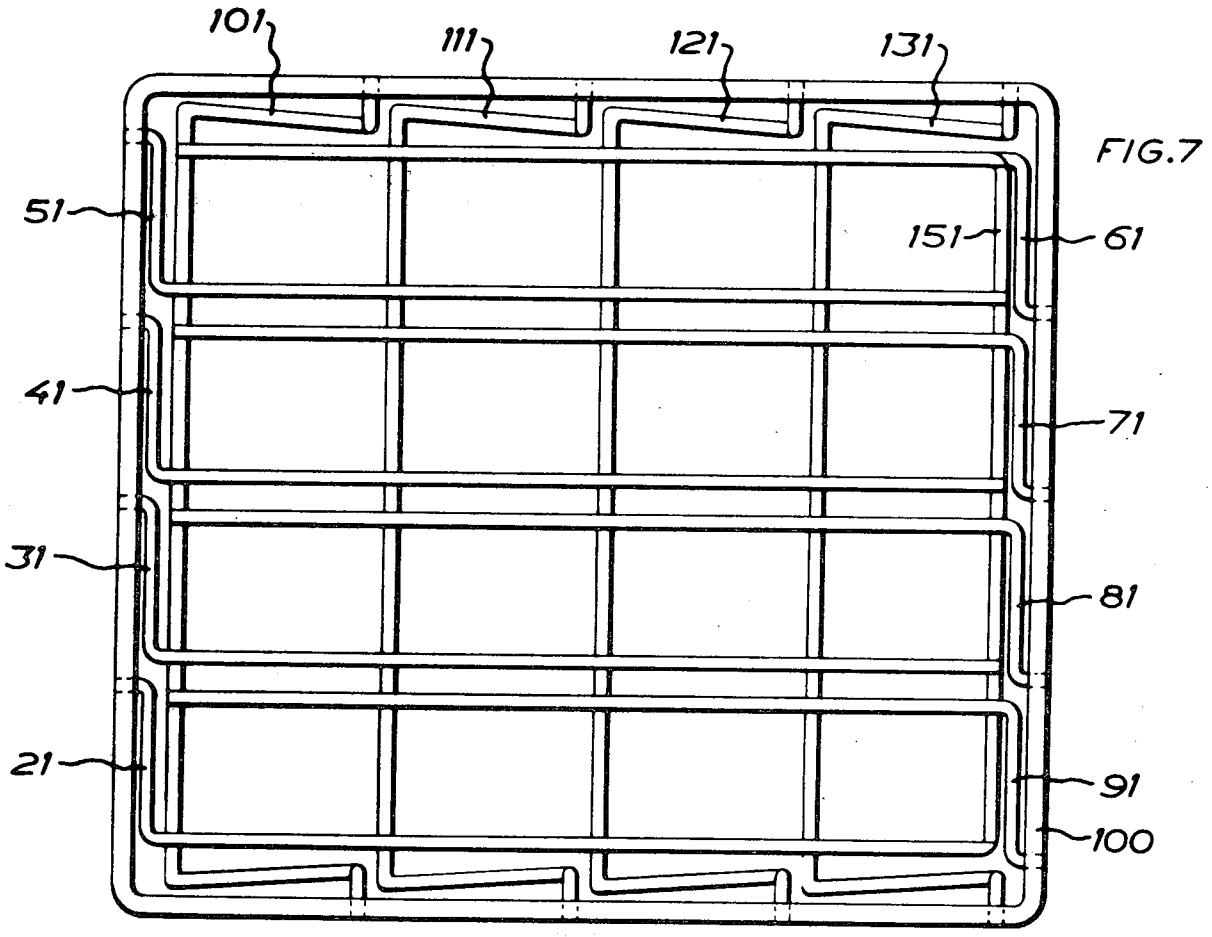
FIG. 7 is a plan view of the basket in FIG. 6.

The wire basket illustrated in FIGS. 6 and 7 is made of a number of wires having circular cross section. The outer contour of the basket is determined by an edge wire which has a slightly larger cross section than the other wires of the basket. Two of the opposed side walls are formed by identical wires 21–51 and 61–91. Apart from forming side walls in the basket, these wires 21–91 also form the bottom of the wire basket in that they extend along said bottom. In the resulting side wall plane the wires 21–51 extend at an angle to the bottom plane as do the wires 61–91. It should be observed, however, that the wires 21–51 are set at an angle in one direction, whereas the wires 61–91 are set at an angle in the other direction. The ends of the wires 21–91 closest to the edge wire 100 are bent outwardly at right angles for enabling their connection with the edge wire 100.

The other two opposed side walls of the wire basket are formed by the wires 101–131. The wires 101–131 are bent in exactly the same manner and extend in the bottom and in the side wals of the basket. The side wall plane formed by the wires 101–131 makes a slightly smaller angle than 90° with the bottom plane. The ends of the wires 101–131 closest to the edge wire 100 are bent to form, on one hand, a supporting surface 141 and, on the other hand, an identical connecting section as the wires 21–91, by which section the wires 101–131 are connected with the edge wire 100.

The wire basket illustrated in FIGS. 6 and 7 besides has a bottom wire 141 which extends along three of the sides of the bottom.

When baskets of the above described construction are to be stacked on top of each other the baskets are rotated through 180 relative to each other, whereby the outer bottom portion of the wires 101–131 will rest on the supporting surface 141. A stack of wire baskets will be very stable since the respective bottom portion of the wires 101–131 will lie at a relative large depth in the subjacent basket.

Figure 12:
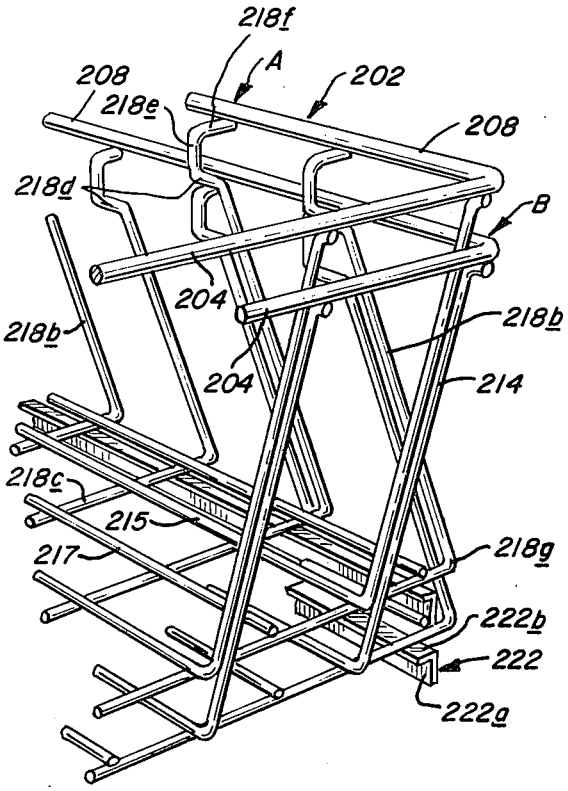
Figure 13:
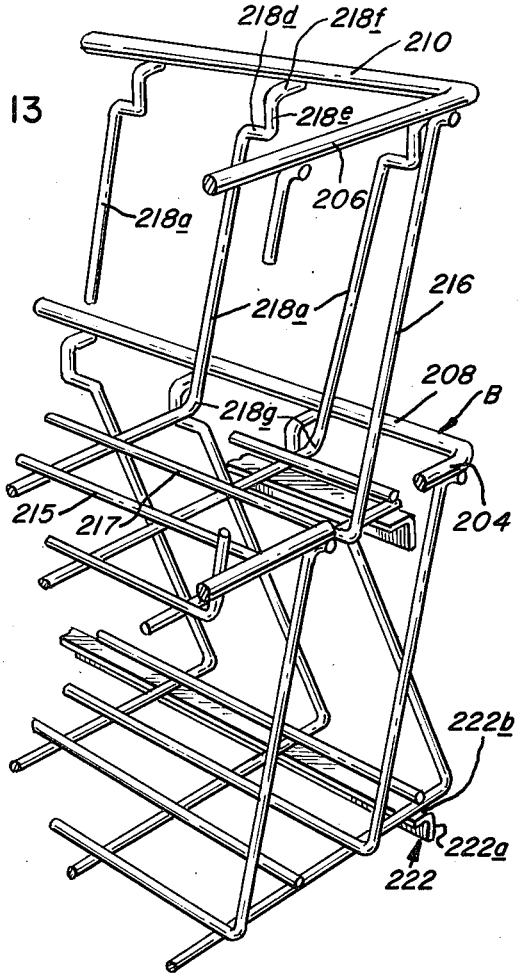

FIGS. 8–13 disclose details of a modified form of basket, generally of the type illustrated in FIGS. 6 and 7. FIGS. 8, 9, and 12 show two identical baskets nested. FIGS. 10, 11, and 13 show two identical wire baskets, or boxes, stacked one upon the other. Since the baskets are identical, the same numerals will be used to describe the elements of the basket. To distinguish the two baskets, the top basket will sometimes be referred to as the A basket, and the lower basket will sometimes be called the B basket. As seen in the Figures, the basket is generally indicated at 200 and includes a generally rectangular top frame 202 having longer side legs shown in elevation in FIG. 9, and end legs of lesser length as shown in FIG. 8. It will be understood that a basket having a square top frame is only a particular form for utilization of the principles disclosed in connection with the rectangular basket.

The rectangular top frame 202 thus provides a shorter pair of frame legs 204 and 206 along the ends of the basket, and a longer pair of frame legs 208 and 210 along the basket sides. The basket bottom is generally indicated at 212, and is defined by a grid of cross wires that are welded together at their points of contact. One set of wires of the grid may be part of the wires that make up the end walls of the basket, and another set may include portions of the wires that make up the side walls of the basket. In the particular construction illustrated, the end wall extending downwardly from top frame leg 204 includes a series of parallel, inclined wires 214 whose upper ends are turned outwardly at **214*a* to connect to the underside of frame leg 204. The lower end of each wire 214 is turned and extends longitudinally of the basket to serve an upper wire 215 of basket bottom 212. The opposite end wall of the basket extending downwardly from top frame leg 206 includes a series of parallel, inclined wires 216 whose upper ends turn outwardly and connect to the underside of top frame leg 206, and the bottom end of each wire 216 turns and runs longitudinally to serve as upper wire 217 of basket bottom 212.** If the basket bottom requires additional longitudinal wires, they may be added as needed or desired, without increasing the number of wires in the end walls.

The cross wires of the basket bottom 212 are the bight portions of the generally U-shaped members whose legs are indicated at **218*a* and 218*b*, and the bight being indicated at 218*c*. The bight portions 218*c* lie crosswise beneath longitudinal wires 215 and 217 and connect thereto. The U-member's legs 218*a* and 218*b* are parallel and are inclined and are arranged in mirror image fashion, with the set of inclined wires 218*b* being arranged to form the side wall of the basket extending downwardly from top frame leg 208 as seen in FIG. 9, and the other set of inclined wires 218*a* forming the opposite side wall of the basket extending downwardly from top frame leg 210.**

In the particular design shown, at least two side wall means are required to maintain the parallel spacing between the basket bottom 212 and the top frame 202. The basket bottom 212 has a rectangular periphery similar to the rectangular periphery of the top frame 202, but the bottom is of smaller peripheral dimensions than the inner peripheral dimensions of the top frame 202, since space must be provided in which the side wall means of the basket are to be positioned, and the effective rectangular periphery of the basket bottom is effectively bounded by vertical planes bounding the innermost extent of such side wall means.

Considering now the wall means, each side and end wall means, whether two or more are used in a basket, is located, or disposed, in a narrow space defined by rather closely spaced vertical planes. The thickness of the wall space is bounded between a vertical projection of the inner periphery of the adjacent frame leg of the top frame, and a vertical projection of the corresponding edge of the basket bottom. This can be best seen, for example, in FIG. 8 where the vertical plane that is the projection of the inner periphery of the frame leg 210 is shown at **210*a* and the vertical projection of the corresponding edge of the basket bottom is shown at 212*a*, and the space between those two procetions is the planar space in which is located the side wall means that correspond with the leg 210 of the top frame 202.**

The wall means in each instance includes only at least one series of spaced parallel wire-like elements, each of substantially the same gauge whose projections or traces onto a vertical plane effectively are seen in the respective elevational views of FIGS. 8–11. Thus, and for example, the vertical extent of the end wall means that is associated with the top frame leg 204 is effectively defined by the five spaced parallel wire-like members 214 each shown as being of substantially the same gauge and whose traces appear as substantially parallel lines inclined to the traces of both the top frame 202 and basket bottom 212. Another requirement of the wire elements making up the wall means of the basket is that projections of the inclined wires 214 onto a horizontal plane shall provide only traces that are each spaced from adjacent traces and also are located spaced inwardly from the trace of the top frame except at the points of interconnection or merging of wires 214 with the top frame and basket bottom. This feature is best seen in FIG. 19, and can also be seen in FIG. 7.

It is desirable and important that the respective inclined wires of the wall means of the baskets, when nested, avoid, as much as possible, being forced together, thereby substantially limiting potential jamming of the wires of the side wall means. Where wires have been jammed together, the generation of interference or friction therebetween may interfere with separation of nested baskets. In order to substantially prevent jamming together of wire elements of the side wall means, a spacing means is provided on each basket for vertically spacing identical baskets, when nested, a distance slightly greater than the gauge of the wire-like elements of the side wall means. In the form of device shown in FIGS. 8–13, the means for so vertically spacing the baskets is by inclusion of two angle-sectioned combination guide and spacer members, in the form of a runner, 222 that extend along the length of the basket adjacent opposite sides, being secured to the underside of the basket bottom 212. One leg 222*a* of the angle section 222 is positioned vertically so that its outer surface will be located approximately in the vertical projection of the corresponding edge of the basket bottom 212, such as indicated by the broken-line trace 212*a*, that is located slightly inwardly of the innermost extent of each side wall means associated with legs 208 and 210 of the top frame. The thickness of support leg 222*a* is selected to fit between trace line 212*a* and the closest adjacent longitudinal cross wire 215 of basket bottom 212. The other flange 222*b* of the guide-space 222 is welded to the underside of the basket bottom 212. Where needed, additional wire spacers, such as shown at 224, may be provided to which the spacer 222 is welded. The degree of vertical nesting will be a function of the vertical width of the spacer leg 222*a*. In stacking, the leg 222*a* lies adjacent upper portions of side wall wires 218*a* and 218*b*, serving a guide or lateral spacer function.

The wall means of basket 200 along the elongated sides thereof at correspond with top frame legs 208 and 210 are each provided with sets of vertically spaced upper and lower abutment elements positioned within the region of the wall means. These abutment elements are arranged to permit basket nesting when the baskets are identically aligned as seen in FIGS. 8 and 9, but which insure basket stacking when the adjacent identical baskets have been rotated relative to each other by 180° to bring opposite walls of the basket into vertical alignment with each other as shown in FIGS. 10 and 11. The abutment means may be provided in various forms, one set being abutment shoulders adjacent the top frame 202, and the other set of abutments being support feet adjacent the basket bottom 212.

In the specific forms shown in FIGS. 6–7 and FIGS. 8–13, the abutment shoulders have been defined by appropriately preforming the inclined wires of the side walls. In FIGS. 8–13, and as most clearly seen in FIGS. 9, the uppermost section of wire 218*b* is bent, or offset, away from the normal line of slope of leg 218*b* to provide a generally horizontal support shoulder 218*d* that merges with a vertical leg portion 218*e* that turns at its upper end outwardly to furnish a connecting leg 218*f* that engages and secures to the underside of the top frame leg 208 by being welded thereto. In plan view, leg 218*b* not only slopes downwardly, from left to right as seen in FIG. 19, but also diverges outwardly so that the lowermost bend at 218*g* forms a support foot which is located to be received in and positioned outwardly of the crotch defined by the leg segments 218*d* and 218*e* as can be most clearly seen in FIG. 10 and FIG. 13.

An important part of the arrangement of the wires 218*a* and 218*b* and their respective sub-portions is that each set of one shoulder 218*d* and one support foot 218*g* of a single wire 218*a* or 218*b* is located within an equal aliquot, sub-portion of the length of the adjacent edge of the basket bottom, and each of the wires 218*a* and 218*b* is offset from the next adjacent wire as clearly shown, for example, in FIGS. 9 and 19. This arrangement permits the nesting of the baskets by merely vertically aligning two baskets A and B and moving basket A vertically down into basket B to the nested position shown in FIGS. 8 and 9. On the other hand, when a basket A has been rotated 180° to the positions of FIG. 10, and basket A then is moved downwardly vertically toward basket B the support foot abutments 218*g* are then so positioned that they automatically engage the abutment shoulders 218*d* on the B basket without any hunting for an exact fit. The guide legs 222*a* fitting between shoulders 218*d* along opposite walls also aids in insuring engagement of the support feet on the support shoulders.

In the specific baskets shown, the side walls associated with the legs 208 and 210 of the top frame have the wire elements thereof arranged in mirror image relation to each other, while the wire elements in the end walls are not arranged in mirror image, but do have an identical rotational relationship relative to a vertical rotational axis that is perpendicular to the center of the basket bottom. Because of this, the wires of the side walls of the stacked A and B baskets appear to slope in different directions in FIG. 10, while the wires 214 and 216 of the end walls of stacked A and B baskets appear to slope in the same direction in FIG. 11.

Figure 14:
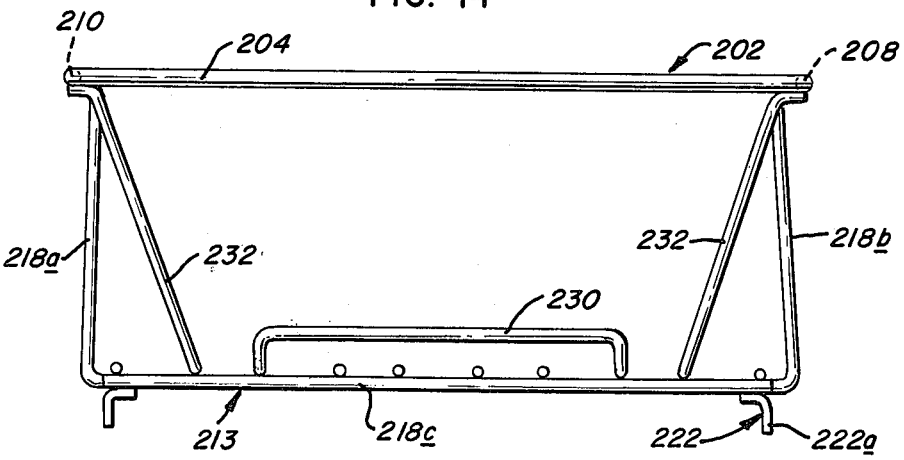
FIG. 14 illustrates, in an end elevational view, a modified form of a basket of the type shown in FIG. 8.

In a modified form of basket construction shown in FIG. 14, the height and lateral extent of the end walls are shown materially reduced so as to provide relatively free access through the end walls. This permits the goods that may be carried in the interior of the basket to be removed from the basket through an end wall. Minimum means for retaining goods in the basket are provided at the end walls, such as by low rise retention bails 230 secured to the basket bottom 213 and by use of minimum number of inclined end wall wires 232.

Figure 15:
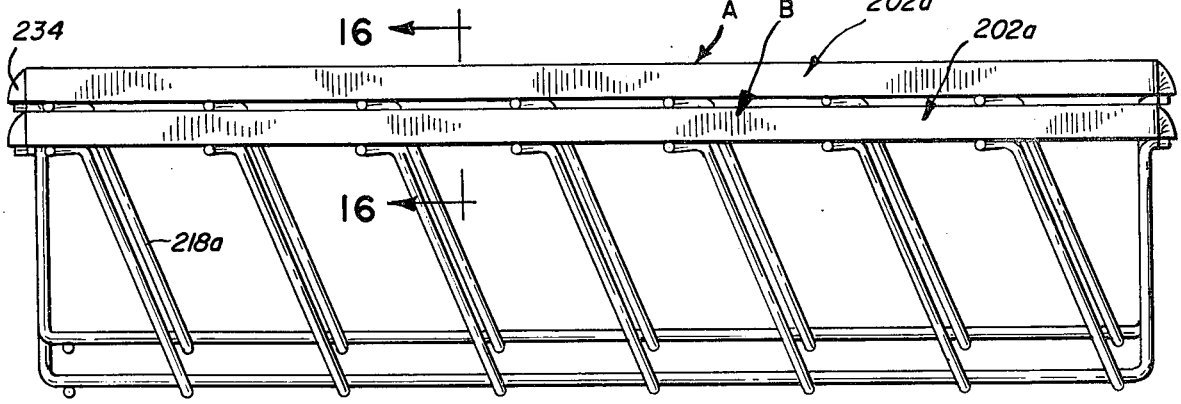
FIG. 15 is a view similar to FIG. 9 showing a further modified form of a basket construction and illustrating two nested baskets.
Figure 16:
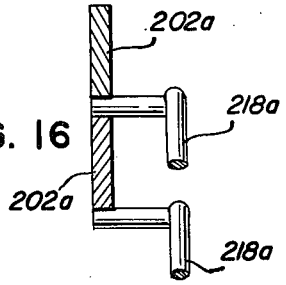
FIG. 16 is a fragmentary cross-sectional view showing the detail taken substantially along line 16—16 of FIG. 15 of the nesting top rims of the baskets.
Figure 18:
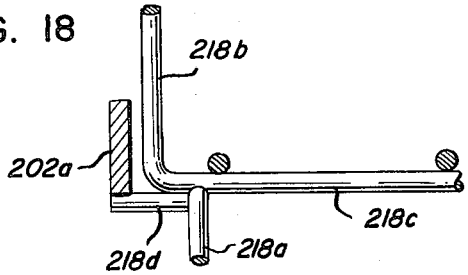
FIG. 18 is a fragmentary cross-section view taken substantially along line 18—18 of FIG. 17 and showing details of the basket in stacking position.
Figure 17:
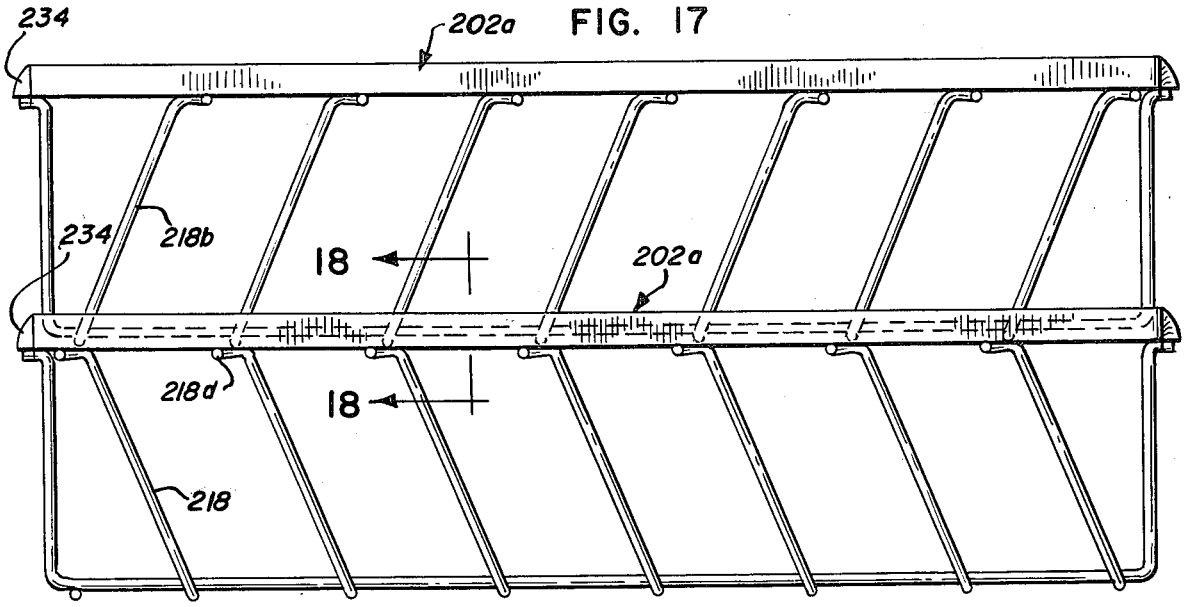
FIG. 17 is a side elevational view similar to FIG. 15, but showing the two baskets stacked by the rotation of the uppermost basket 180° from the position shown in FIG. 15.

In another modified form of basket illustrated in FIGS. 15–18, the means for spacing the nested baskets is provided in the shape and construction of the top frame wire 202*a* of the basket and the upper ends of the side wall wires are slightly modified. The top frame 202*a* is in the form of a flat wire whose width dimension is greater than its thickness, and the width is disposed vertically and arranged to engage a similar top frame wire of another basket. The width of the wire 202*a* is selected to be greater than the gauge of the wires of the wall means. The wall wires at their upper ends have the support shoulders 218*d'* extend to engage the underedge of the wires 202*a* as seen in FIG. 16. As shown in FIGS. 15 and 17, but best seen in the perspective view, FIG. 22, the flat wires 202*a* may have portions 234 offset by twisting to provide a space or access opening between adjacent abutting top frames 202*a* of the nesting baskets.

While in the form of basket shown in FIGS. 8–13, the abutment means in the side walls such as the abutment shoulders and support feet are formed as integral segments of the wire-like elements of the side wall means, it will be understood that the abutments may be separate from the wire elements and may be formed in different ways. Thus, in the variant shown in FIGS. 20–22 abutment shoulders 240 are provided as tabs, flanges, or ledges that project inwardly from the top frame wire 202*a* at the region where the abutment shoulder should be located. The wire elements may still form the support feet, and need only be inclined upwardly, from right to left as viewed in FIG. 20. In the form shown in FIGS. 20–22, the abutment shoulder 240 is located in the area previously occupied by the abutment shoulder 218*d*, and is separate from the wire 218*b* that forms part of the side wall means. The wire 218*b* may still be used to provide the support foot 218*g* for cooperation with the abutment shoulder 240.

The wires 214 and 216 that define the end walls of the baskets are slightly offset, a distance in the range of the gauge of the wires, inwardly of top frame wire legs 204 and 206 respectively providing effectively vertical planes that bound the ends of the goods-enclosing space of the basket, and at the same time the outer surfaces of the lower ends of such wires 214 and 216 guidingly cooperate with the inner edges of frame legs 206 and 204 respectively during stacking of basket A on basket B to precisely locate the abutment feet above the abutment shoulders in the basket side walls.

The wires 218*a* and 218*b* each are identically formed but have mirror image relation to each other. These side wall wires have portions that are maximally offset inwardly of the frame wire legs 208 and 210 a substantially greater distance than the slight inward offset of wires of the end walls. The portions 218*d* of wires 218*a* and 218*b* operate to define the vertical planes that bound the sides of the goods-enclosing space of the basket. In order to limit shifting of basket A relative to basket B in directions normmal to top frame legs 208 and 210, there is the adjacency relationship of wire portions 218*d* to angle legs 222*a* in the construction of FIGS. 8–13, and there is the adjacency relationship of the lower ends of wires 218*a* and 218*b*, above the foot abutment 218*g*, respectively with legs 210 and 208 during stacking, as illustrated in FIG. 22.

Figure 23:
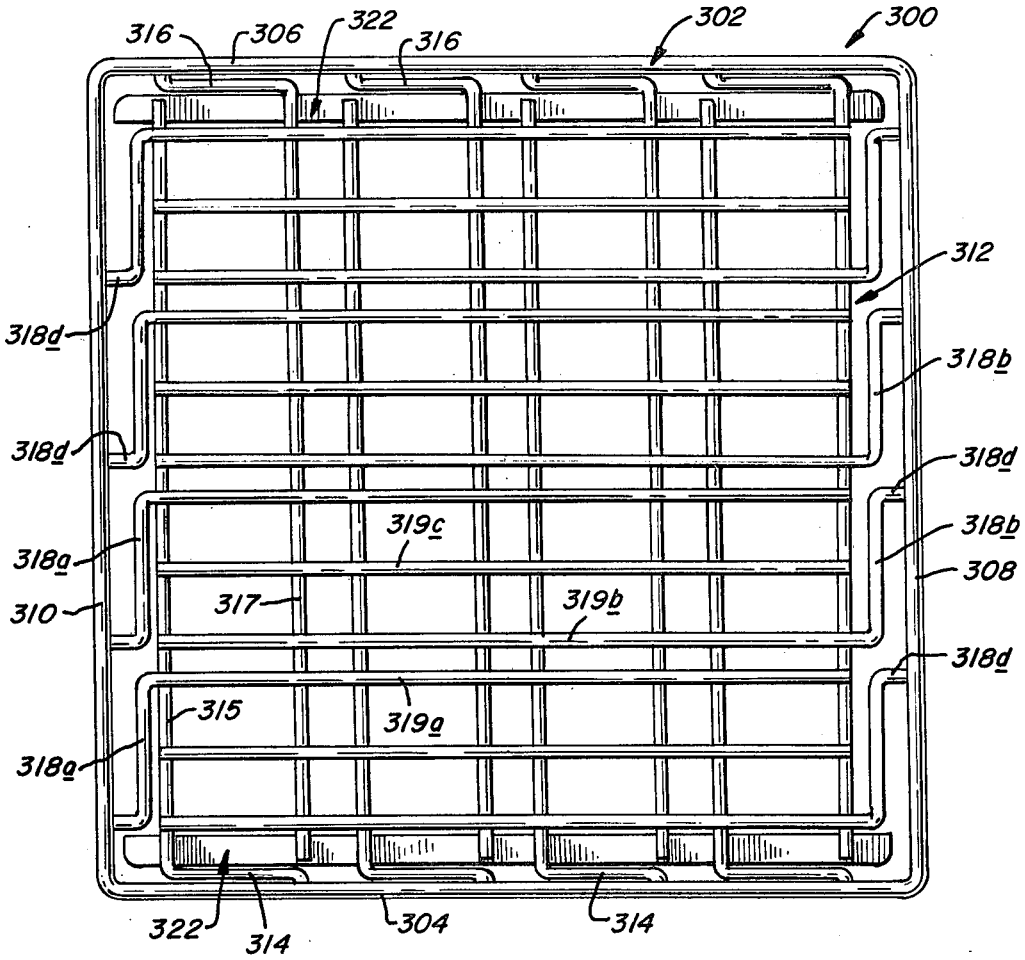
FIG. 23 is a plan view of a modified form of basket construction of generally square cross-section, the view being similar generally to the generally square cross-section shown in FIG. 3, but illustrating different constructional details in the wire elements of the side wall means and basket bottom.
Figure 24:
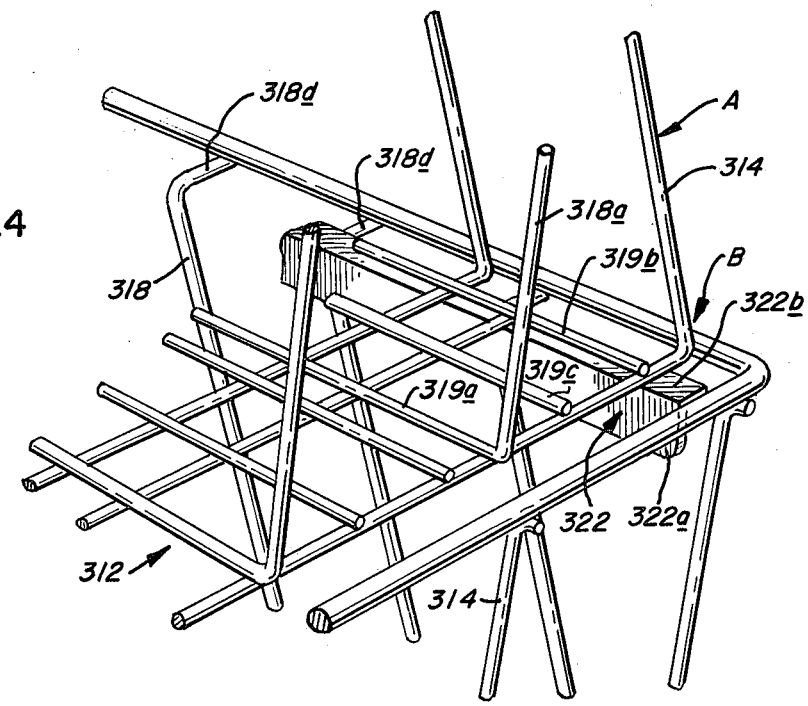
FIG. 24 is a fragmentary perspective view similar to FIG. 13 showing two baskets of the type shown in plan view of FIG. 23, but in stacking position.
Figure 25:
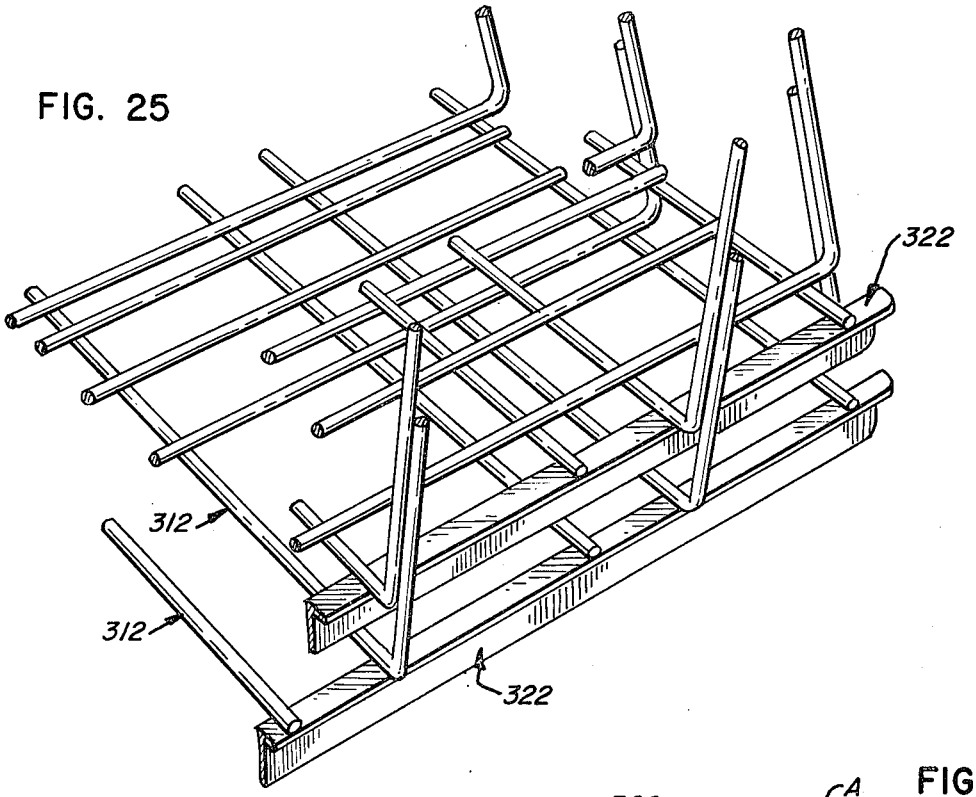
FIG. 25 is a fragmentary perspective view of a lower corner of two nested baskets of the type shown in FIGS. 23 and 24.

In the form of device shown in FIGS. 23–27, the basket is generally of square cross section and the elements of the basket are so arranged that when two baskets are identically aligned they will nest, but when rotated 90° about a vertical axis through the center of the basket bottom the baskets will stack. The construction shown in the plan view of FIG. 23 is similar in many respects to the construction shown in FIG. 3. The numbers used to identify parts of the basket follow the numbering in the description of FIGS. 8–13 increased by 100 so that the new reference numerals are in the 300 series.

In the construction of FIGS. 23–27, the basket is generally 300, the top frame wire, generally 302, includes elongated legs 304, 306 associated with a first pair of opposite sides and legs 308 and 310 associated with the other pair of opposite sides. The basket bottom 312 is defined by crossing wires. The pair of all means associated with legs 304 and 306 are defined by inclined wires respectively 314 and 316 whose lower ends are turned to provide lower cross wires, respectively, 315 and 317 of the bottom 312. The walls associated with legs 304 and 306 are spaced inwardly of those legs only a slight amount, while the walls associated with legs 308 and 310 project inwardly of wires 308 and 310 a greater amount to provide support shoulders 318*d*. The wires that form the walls associated with legs 308 and 310 are separate so that wires 318*a* and 318*b* now each turn inwardly at their lower ends to define upper cross wires 319*a* and 319*b* respectively of the basket bottom, and additional wires 319*c* may be included as needed.

Figure 26:
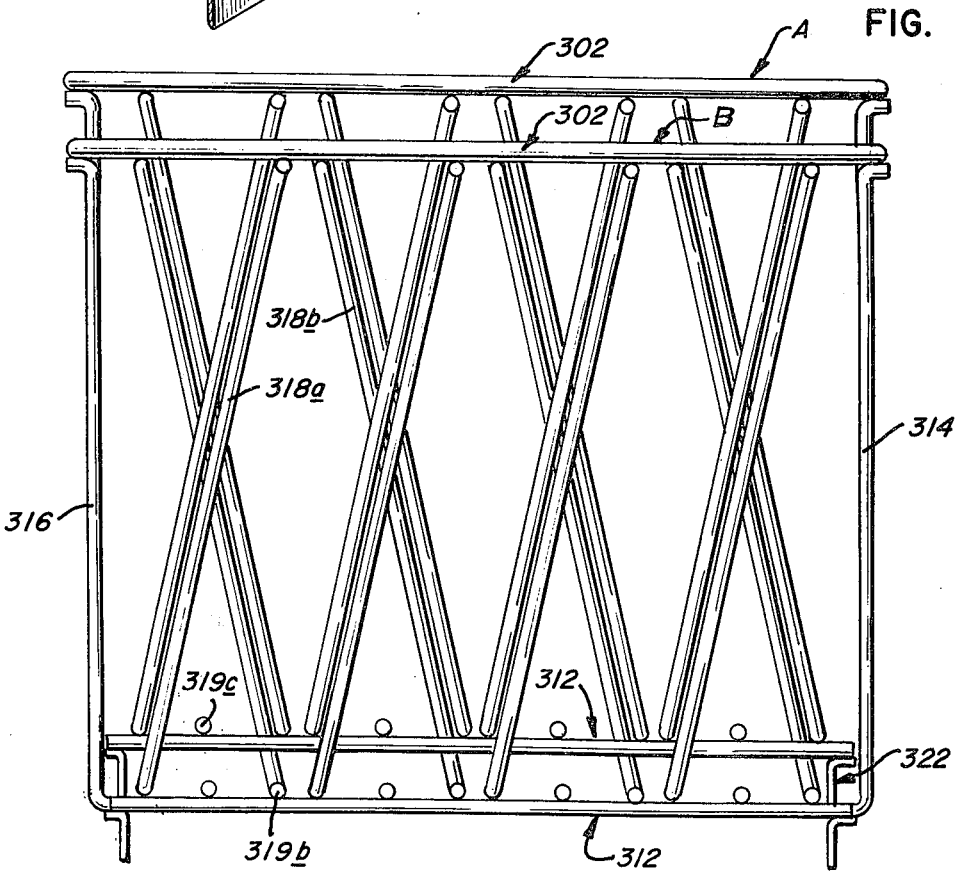
FIG. 26 is a side elevational view showing two baskets of a type of FIGS. 23 and 24 in nested condition.
Figure 27:
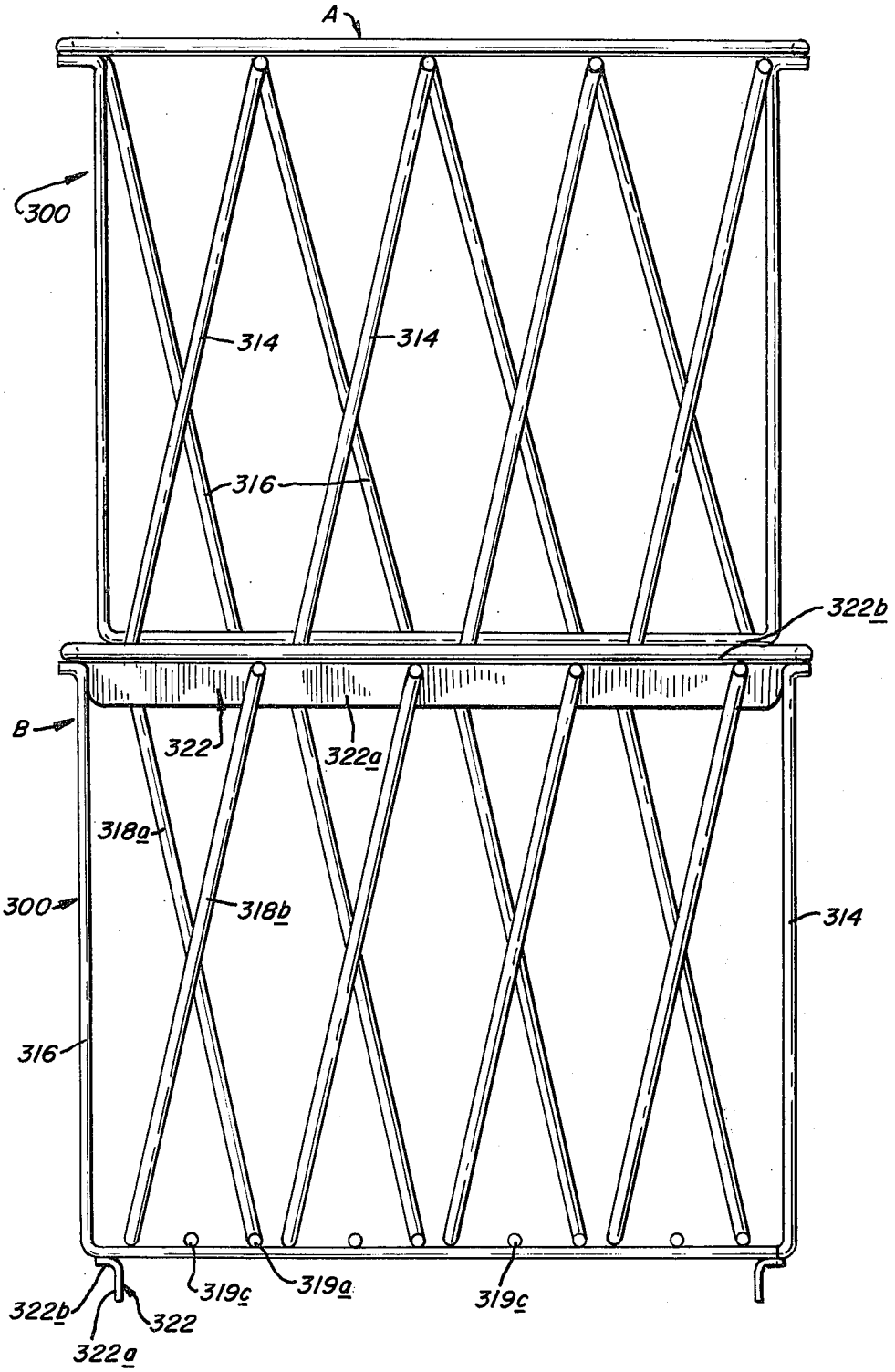
FIG. 27 is a side elevational view showing baskets of the type in FIGS. 23–26 in stacked condition.

The underside of basket bottom 312 is provided, adjacent the edges associated with opposite top frame wires 304 and 306, with spacing and stacking rails 322 of angle-shaped cross-section, with leg 322*a* serving when baskets A and B are nested, as seen in FIG. 26, to support basket A on the basket bottom 312 of basket B. The securement of side wires 319*a* and 319*b* to legs 308 and 310 by wire segments 319*d* is, as seen in FIG. 23, spaced from legs 304 and 306 so as to provide unobstructed vertical slideways adjacent inner surfaces of wires 314 and 316, so that rails 322 move down into basket B to the position in FIG. 26. On the other hand, when basket A is rotated 90° about a vertical axis through the center of basket bottom 312, rails 322 move to the positions seen in FIGS. 24 and 27 where the horizontal leg 322*b* of the rails will serve as a foot support that engages the series of shoulder supports 318*d* so as to effect stacking of basket A on basket B.

What I claim and desire to secure by Letters Patent is:

1. In a basket construction including a generally rectangular top frame defining elongated frame legs, a similar rectangular basket bottom of smaller peripheral dimensions than the inner periphery of the top frame, at least two side wall means extending between said top frame and basket bottom to maintain said frame and bottom in spaced parallel relation, each said side wall means being disposed in vertical planes whose thickness is bounded between a vertical projection at the inner periphery of the frame leg of the top frame and a vertical projection of the corresponding edge of the basket bottom, the vertical extent of each side all means being defined by a series of spaced, parallel, inclined, wire-like elements of substantially the same gauge whose horizontal projections onto a vertical plane, that is substantially parallel to the wall means, are substantially parallel lines inclined to the traces of the spaced parallel top frame and basket bottom, and whose projections, onto a horizontal plane provide traces that are spaced from each other and from the traces of the top frame, means on the basket for spacing two identical nested baskets a distance greater than the gauge of the wire-like elements of the side wall means, whereby to prevent said upright elements of the side wall means of one nesting basket from substantial contact with the similar elements of adjacent nested baskets, the side wall means along a pair of parallel sides of the basket providing abutment elements which permit basket nesting when baskets are identically aligned and provided for basket stacking when vertically adjacent identical baskets are rotated relative to each other to bring different side wall means of the basket into vertical alignment with each other.

2. A basket construction as in claim 1 wherein the abutment elements of each side wall means include multiple sets of both an abutment shoulder and a support foot whose vertical projections onto a horizontal plane provide traces located only in the region bounded by said vertical planes which define the respective side wall means, each said set of shoulder and foot being located within an aliquot sub-portion of the length of a vertical projection of the adjacent edge of the basket bottom, each said shoulder and foot traces having a length parallel to the adjacent top frame leg that is less than the minimum spacing between two adjacent elements of the side wall means, and portions of side wall means of an upper basket telescoping within the top frame of a lower basket and aligningly cooperating therewith when the baskets have been rotated away from an identical arrangement, so as to locate abutment feet of one wall means vertically above abutment shoulders of another wall means to effect proper alignment for stacking baskets one on top of another.

3. A basket as in claim 2 wherein both the abutment shoulders and support feet are formed as part of the wire-like elements of the sidewall means.

4. A basket as in claim 2 wherein the abutment shoulders are formed integral with the top frame and extend inwardly of the frame legs of the top frame, and wherein the support feet are formed as part of the wire-like elements of the side wall means.

5. A basket as in claim 1 wherein the side wall means of one pair of parallel sides of the rectangular basket are in mirror image relation to each other, and the side wall means of the other parallel sides of the basket are identical in a rotational relationship relative to a vertical rotational axis that is perpendicular to the center of the basket bottom.

6. A basket as in claim 1 wherein the means for spacing the nested baskets a distance greater than the gauge of the wire-like elements includes means on the underside of the basket bottom.

7. A basket as in claim 1 wherein the means for spacing the nested baskets a distance greater than the gauge of the wire-like elements includes means on the top frame of the basket.

8. A basket as in claim 1 wherein the means for spacing the nested baskets a distance greater than the gauge of the wire-like elements includes a portion of a metal wire whose vertical dimension is greater than the maximum gauge of the wire-like elements, serving as the top frame of the basket.

9. A basket as in claim 8 wherein portions of the metal wire are offset to provide access openings between adjacent abutting top frames of nesting baskets.

10. A basket as in claim 1 wherein the basket bottom is defined in part by extensions of the wire-like elements of the side walls bent to lie substantially in a horizontal plane and welded together.

11. A basket as in claim 1 wherein side wall means are provided below the frame legs of the rectangular top frame along only two opposite sides of the rectangular basket, and the other two sides of the rectangular basket below the frame legs of the rectangular top frame being substantially open to permit withdrawal of goods stored in the basket through such substantially open sides of the basket.

12. A basket as in claim 1 wherein a basket either nests or stacks with an identical basket upon rotation of 180°.

13. A basket as in claim 1 wherein the top frame and basket bottom are square, and there being four side wall means extending between top frame and basket bottom, each side wall means providing abutment elements therein, and the rotation of a basket being 90° between nesting and stacking attitudes relative to an identical basket.

14. In a basket construction wherein an identical pair of baskets of generally rectangular periphery are adapted to be selectively stacked or nested, respectively either one above another or one within the other, by merely rotating one basket in its plane about a vertical axis, the baskets being nestable when corresponding walls of the baskets are in vertical alignment with each other and the baskets stacking when different walls of the baskets are in vertical alignment with each other, the improvement comprising, in combination:

each basket having a top frame of rectangular periphery providing generally straight peripheral frame legs, and a basket bottom of generally rectangular periphery, with frame legs of the top frame being joined to the basket bottom by side walls means that include at least one pair of opposite side walls that are a mirror image of each other;

each of said mirror image side walls being disposed in a vertical plane whose thickness is bounded between a vertical projection of the inner periphery of the associate frame leg of the top frame and a vertical projection of the corresponding edge of the basket bottom;

said mirror image side walls each including in said vertical plane thereof, a first plurality of longitudinally spaced upper abutments and a second plurality of longitudinally spaced lower abutments respectively adjacent the top frame and basket bottom, inclined upright spacer members extending between the top frame and the basket bottom, said abutments and spacer members being constructed and arranged so that the lower abutments on an upper basket engage upper abutments on a lower basket when the baskets are stacked, and with the lower abutments on the upper basket being longitudinally offset relative to the upper abutments on a lower basket when the baskets are nested.

15. A basket construction as in claim 14 wherein each of the plurality of spaced upper abutments of a side wall on a basket are offset longitudinally of each of the plurality of spaced lower abutments on the said side wall of the basket.

16. A basket construction as in claim 15 wherein the inclined upright spacer members extend between upper abutments and lower abutments.

17. A basket construction as in claim 16 wherein the inclined upright spacer members extend between upper abutments and lower abutments and the upper abutments and lower abutments are both formed integral with and as part of the inclined upright members.

18. A basket construction as in claim 16 wherein the inclined upright spacer members extend between upper abutments and lower abutments and one set of abutments is formed integral with and as part of the inclined upright members, and the other abutments are provided on one of the top frame or basket bottom.

19. A basket construction as in claim 16 wherein the inclined upright spacer members extend between upper abutments and lower abutments and the lower set of abutments is formed integral with and as part of the inclined upright members, the top frame being in the form of a flat wire whose edges are disposed vertically of the basket, and the upper set of abutments being provided as flanges integral with and extending inwardly from the top frame.

20. A basket construction as in claim 14 wherein the inclined upright spacer members are elongated wires that are shaped to provide upper abutments at the ends thereof adjacent the top frame and bottom abutments at the ends thereof adjacent the basket bottom.

21. A basket construction as in claim 14 wherein the top frame is provided by a flat wire whose width is greater than its thickness, the flat wire being disposed so its width generally extends vertically of the basket.

22. A basket construction as in claim 21 wherein the flat wire of the top frame has a plurality of spaced flanges thereon extending inwardly thereof to provide the plurality of upper abutments.

* * * * *